US005633558A

United States Patent [19]

Watanabe et al.

[11] Patent Number: 5,633,558

[45] Date of Patent: May 27, 1997

[54] COLOR CATHODE-RAY TUBE INCLUDING A SHADOW MASK HAVING HOLES ARRANGED WITH A MONOTONICALLY NON-DECREASING ARRANGEMENT PITCH

[75] Inventors: Mitsuru Watanabe; Naoyuki Katoh, both of Mobara, Japan

[73] Assignee: Hitachi, Ltd., Tokyo, Japan

[21] Appl. No.: 214,278

[22] Filed: Mar. 17, 1994

[30] Foreign Application Priority Data

Mar. 19, 1993 [JP] Japan ..... 5-060432

[51] Int. Cl.[6] ..... H01J 29/07

[52] U.S. Cl. ..... 313/402; 313/403; 313/408

[58] Field of Search ..... 313/402, 403, 313/408

[56] References Cited

U.S. PATENT DOCUMENTS

| | | | |
|---|---|---|---|
| 4,475,056 | 10/1984 | Hirai | 313/402 |
| 4,583,022 | 4/1986 | Masterton | 313/402 |
| 4,727,282 | 2/1988 | Tokita et al. | 313/403 |
| 4,743,795 | 5/1988 | Thoms | 313/402 |
| 5,155,410 | 10/1992 | Wakasono et al. | 313/402 |

FOREIGN PATENT DOCUMENTS

| | | |
|---|---|---|
| 0 146 926 A3 | 7/1985 | European Pat. Off. . |
| 0 239 083 A3 | 9/1987 | European Pat. Off. . |
| 59-165341 | 9/1984 | Japan . |
| 1-77841 | 3/1989 | Japan . |

*Primary Examiner*—Sandra L. O'Shea
*Assistant Examiner*—Matthew J. Esserman
*Attorney, Agent, or Firm*—Antonelli, Terry, Stout & Kraus, LLP

[57] ABSTRACT

In a color cathode-ray tube having a glass envelope including a panel portion, neck portion and a funnel portion coupling the panel and neck portions to each other, an electron gun mounted within the neck portion for producing electron beams, a phosphor screen formed on an inner surface of a faceplate the panel portion and a shadow mask having a plurality of holes therein and disposed opposing the phosphor screen so that the electron beams pass through holes in the shadow mask to impinge on the phosphor screen, the holes in the shadow mask are arranged with a varying arrangement pitch which is monotonically non-decreasing from a central portion to two opposite peripheral portions of the shadow mask as viewed, in a horizontal direction in the color cathode-ray tube, at an arbitrary position on the shadow mask in a vertical direction in the color cathode-ray tube. The rate of increase of the varying arrangement pitch in the horizontal direction is substantially zero in first regions from the central portion to intervening portions between the central portion and the two opposite peripheral portions of the shadow mask, and has a gradient not smaller than zero in second regions from the intervening portions to the two opposite peripheral portions of the shadow mask.

18 Claims, 4 Drawing Sheets

COLOR CATHODE-RAY TUBE INCLUDING A SHADOW MASK HAVING HOLES ARRANGED WITH A MONOTONICALLY NON-DECREASING ARRANGEMENT PITCH

BACKGROUND OF THE INVENTION

This invention relates to a shadow mask having holes arranged with a varying, not constant, arrangement pitch for use in a color cathode-ray tube, and to a color cathode-ray tube having such a shadow mask.

In general, a color cathode-ray tube for displaying a color video image is formed of a panel portion with a phosphor screen formed on a inner surface of a faceplate, a neck portion in which an electron gun is provided for generating three electron beams, and a funnel portion for connecting the panel portion to the neck portion. The funnel portion has provided thereon a deflector for deflecting the electron beams emitted from the electron gun, causing the beams to scan the phosphor screen.

The electron gun has various electrodes such as cathode electrodes, control electrodes, focus electrodes and accelerating electrodes. Three electron beams emitted from the cathode electrodes are modulated by image signals which are supplied to the control electrodes, and then passed through the focus electrodes and accelerating electrodes, thereby having their energy increased. The electron beams impinge on the phosphor screen. During the period in which the three electron beams are emitted from the electron gun and arrive at the phosphor screen, they are horizontally and vertically deflected by the deflector which is provided on the funnel portion, and then, as is well known, pass through holes in a shadow mask to produce a color video image on the phosphor screen which is provided just after the shadow mask. In this case, the shadow mask is formed in a curved shape which matches a curved shape (a slightly spherical shape) of the faceplate of the panel portion, and the arrangement pitch of the holes in the shadow mask is determined in accordance with this curved surface.

FIGS. 1*a* and 1*b* are schematic diagrams to which reference is made to explain how to determine the horizontal arrangement pitch of the holes in the shadow mask. FIG. 1*a* is a cross-sectional diagram of part of the inside of the panel portion of a color cathode-ray tube, and FIG. 1*b* is a plan view of part of the shadow mask.

In FIGS. 1*a* and 1*b*, 50 denotes a faceplate of the panel portion, 51 a shadow mask, 52 a central axis of the tube, 53 an electron beam, 54 a center of deflection of the electron beam 53, 55 slit-shaped electron beam passage holes, and $\mathbf{56}_0$, $\mathbf{56}_1$, $\mathbf{56}_2$, $\mathbf{56}_3$ . . . $\mathbf{56}_{n-1}$, $\mathbf{56}_n$, $\mathbf{56}_{n+1}$, $\mathbf{56}_{n+2}$ the vertical center lines connecting respective electron beam passage holes 55.

Within the panel portion of the cathode-ray tube, the shadow mask 51 formed in a slightly spherical curved shape is disposed, in substantially parallel to and opposing, faceplate 50 which is also formed similarly in a slightly spherical curved shape. The electron beam 53 emitted from the electron gun (not shown) and traveling along the tube axis 52 is, for example, horizontally deflected, at the deflection center 54, and then projected through the shadow mask 51 to the phosphor screen (not shown) which is provided on the faceplate 50.

Here, the distance between the shadow mask 51 and the faceplate 50 along the path of the electron beam 53 is represented by $b_n$, the distance between the deflection center 54 and the faceplate 50 by $d_n$, the pitch (hole arrangement pitch) of the vertical center lines $\mathbf{56}_{n-1}$, $\mathbf{56}_n$ by $a_n$, and a constant to be determined by the deflector (not shown) by S. Then, the distance $b_n$ can be expressed by the equation of $b_{n=an\cdot dn/}3S$, or satisfies the relation of $b_n \alpha a_n$. Thus, the distance $b_n$ is determined over the entire surface of the shadow mask 51, and the shape of the shadow mask 51 is determined so that this distance $b_n$ is smoothly or continuously changed over the entire surface, and the hole arrangement pitch $a_n$ at each portion is determined in accordance with the shape of the shadow mask.

In this case, the shape of the known shadow mask 51 is designed so that the radius of curvature at the periphery (represented by R2) is somewhat smaller than that at the center (represented by R1), or that R1>R2. Thus, the pitch of a large number of electron beam passage holes provided in the shadow mask 51 is gradually increased from the center toward the periphery.

The shadow mask 51 is generally made of a thin iron plate about 0.1 to 0.3 mm thick, and is shaped so that it is slightly spherical as described above. Since the whole mask is made of a thin iron plate, its strength is not enough, and thus this mask has various known problems as described below.

When the electron beam 53 impinges on the shadow mask, the shadow mask 51 thermally expands due to heat generated by the impingement. As a result, the trajectory of the electron beam 53 is changed, causing purity degradation, namely, a so-called "doming" occurs Further, the shadow mask 51 may be resonant to sound (particularly from a loud speaker) generated by the television set or a vibration, causing purity degradation, or a so-called howling. In addition, the shadow mask 51 may be deformed by a shocks occuring during a manufacturing process for the color cathode-ray tube or transportation thereof, thus causing purity degradation.

A color cathode-ray tube in which the shadow mask is designed so that the distance between adjacent columns of holes in the shadow mask is the greatest at its central and end portions and is the smallest midway between the central and end portion is disclosed in JP-A-59-165341(published on Sep. 18, 1984).

SUMMARY OF THE INVENTION

Accordingly, it is one object of the invention to provide a shadow mask which is suitable for use in a color cathode-ray tube, and which is improved in its mechanical strength so that it can be prevented from being deformed by doming, howling and/or shock.

It is another object of the invention to provide a color cathode-ray tube using the above-mentioned shadow mask.

According to one aspect of the present invention, a shadow mask for use in a color cathode-ray tube has a metal plate in which a plurality of holes are formed for passage of electron beams therethrough in the color cathode-ray tube, and the holes are arranged with a varying arrangement pitch which is monotonically non-decreasing from a central portion to two opposite peripheral portions of the shadow mask as viewed, in a first direction conforming with a horizontal direction in the color cathode-ray tube, at an arbitrary position on the shadow mask in a second direction perpendicular to the first direction. An increase of the varying arrangement pitch in the first direction is substantially zero in first regions from the central portion to intervening portions between the central portion and the two opposite peripheral portions of the shadow mask, and has a gradient not smaller than zero in second regions from the intervening portions to the two opposite peripheral portions of the shadow mask.

The term "arrangement pitch" of holes in the shadow mask is the center-to-center distance between adjacent holes or between alternately adjacent holes.

According to another aspect of the invention, there is provided a color cathode-ray tube which includes an envelope having a panel portion, a neck portion and a funnel portion coupling the panel portion and the neck portion to each other, a shadow mask disposed opposing a phosphor screen formed on an inner surface of a faceplate of the panel portion, an electron gun mounted within the neck portion so as to emit electron beams toward the screen, and a deflector provided around the junction between the neck portion and the funnel portion so as to deflect the electron beams, causing them to scan the phosphor screen, wherein the shadow mask has provided therein electron beam passage holes of having a horizontal arrangement pitch which is substantially constant in first regions ranging from a central portion to intervening portions which lie between the central portion and peripheral portions, and rapidly increases in second regions ranging from the intervening portions to the peripheral portions.

According to the above structure, the shadow mask for use in a color cathode-ray tube has its radius of curvature in a cross-section thereof made substantially constant in the regions ranging from the central portion and its vicinity to the intervening portions and their vicinity, but has its radius of curvature gradually reduced in the regions ranging from the intervening portions and their vicinity to the peripheral portions and their vicinity from the intervening portions toward the peripheral portions. In other words, if the radius of curvature at the central portion and its vicinity of the shadow mask is represented by R1 and that at the peripheral portions and their vicinity by R2, the shadow mask can be shaped to satisfy the condition of R1>R2. Thus, the mechanical strength of the shadow mask of the invention is larger than the known shadow mask, with a result that the shadow mask of the invention is less subject to being deformed by a shock or the like and is less subjected to doming and howling.

DESCRIPTION OF THE PREFERRED EMBODIMENTS

Figure 1A:
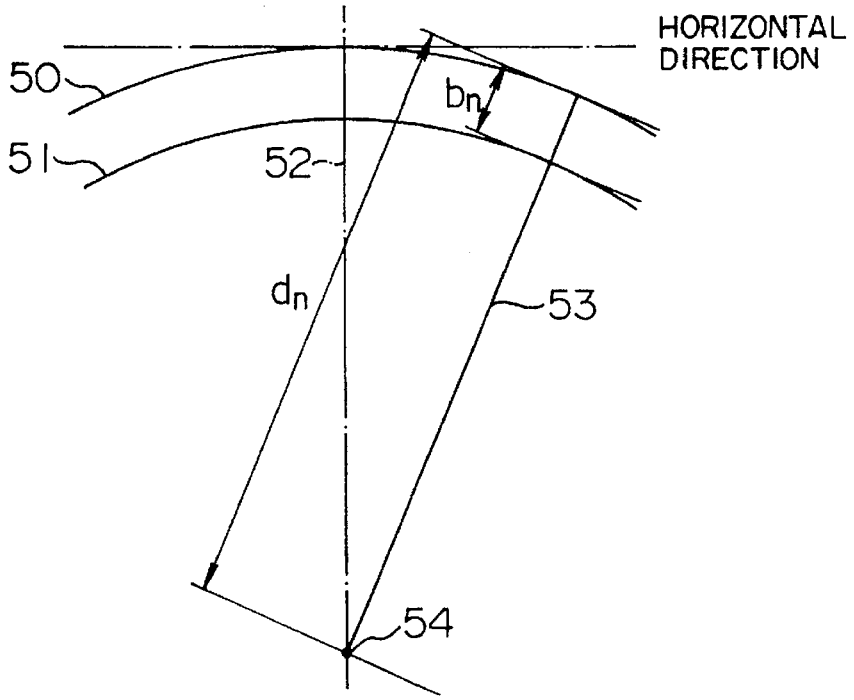
FIGS. 1*a* and 1*b* are schematic diagrams for use in explaining how to determine the horizontal arrangement pitch of the holes of the shadow mask.
Figure 1B:
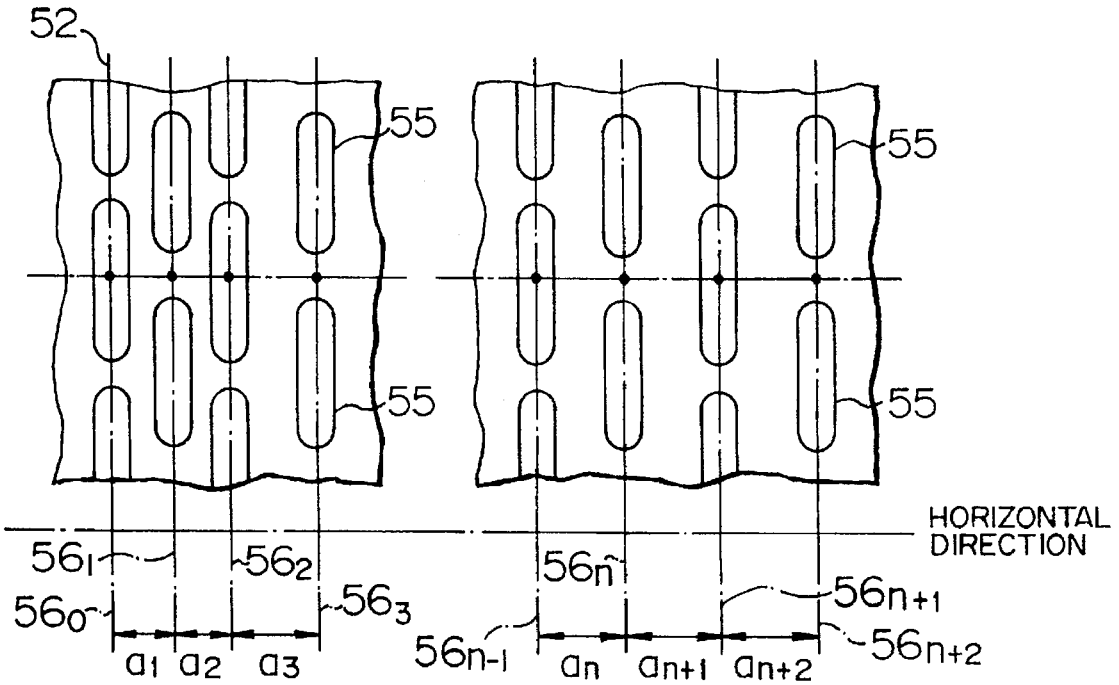
Figure 2:
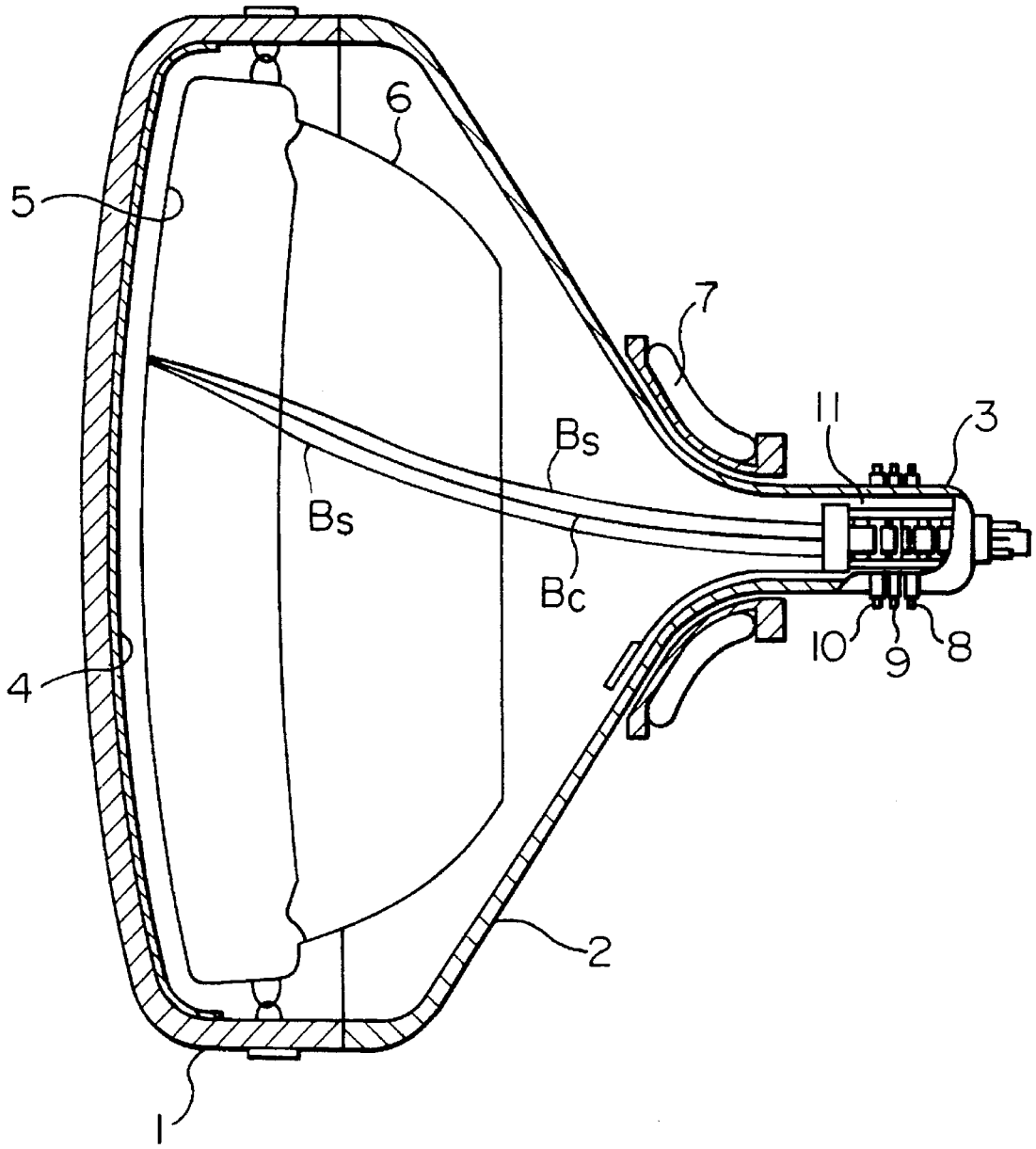
FIG. 2 is a schematic view of the structure of the color cathode-ray tube of one embodiment of the invention.

FIG. 2 is a longitudinal cross-sectional diagram of a color cathode-ray tube according to one embodiment of the invention. Referring to FIG. 2, there are shown a panel portion 1, a funnel portion 2, a neck portion 3, a phosphor screen (picture screen) 4, a shadow mask 5, a magnetic shield 6, a deflection yoke 7, a purity adjustment magnet 8, a center beam static convergence adjustment magnet 9, a side beam static convergence adjustment magnet 10, an electron gun 11, a center beam Bc, and two side beams Bs.

The panel portion 1 at the front of the color cathode-ray tube is coupled to the neck portion by the funnel portion 2. These portions constitute an envelope made of, for example, glass as a whole. The panel portion 1 has the phosphor screen 4 formed on the inner side of its faceplate, and the shadow mask 5 is disposed opposing the back of the phosphor screen 4. In this case, the faceplate and the shadow mask 5 are each formed in a slightly curved shape (a spherical shape having a large radius of curvature). The magnetic shield 6 is provided behind the shadow mask 5, and the deflection yoke 7 is provided around the junction between the funnel portion 2 and the neck portion 3 on the outside of the envelope. The neck portion 3 has the electron gun 11 provided therein for emitting the single center beam Bc and two side beams Bs, and the center beam static convergence adjustment magnet 9 and side beam static convergence adjustment magnet 10 are disposed on the outside of the neck portion.

Figure 3A:
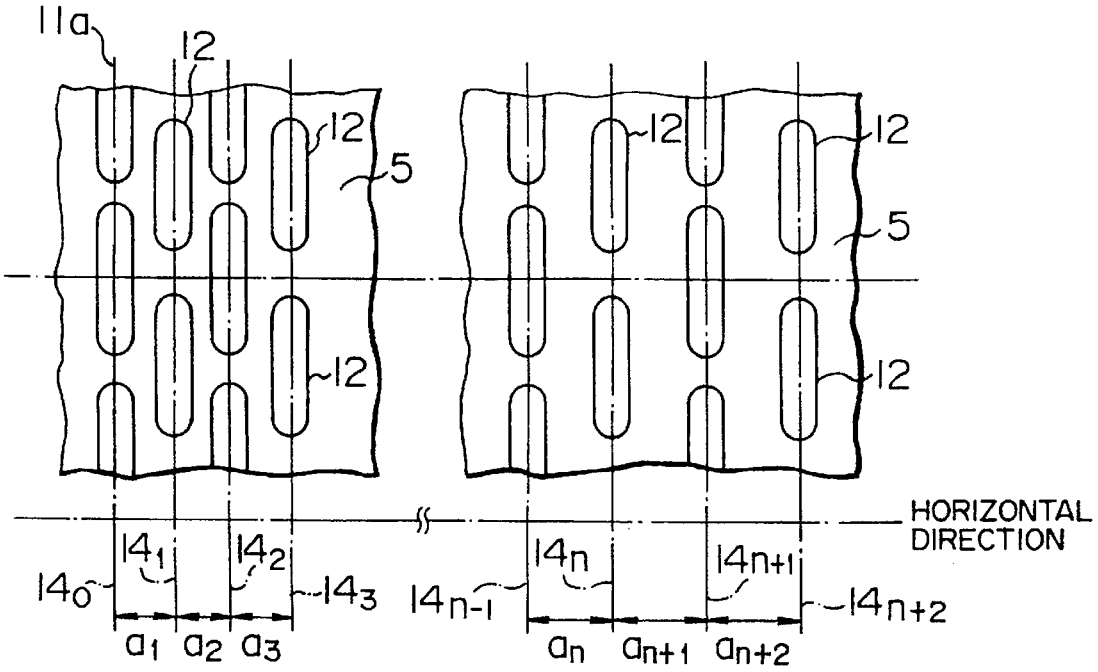
FIGS. 3*a* and 3*b* are diagrams of the structure of part of the shadow mask of one embodiment of the invention for use in the color cathode-ray tube shown in FIG. 2.
Figure 3B:
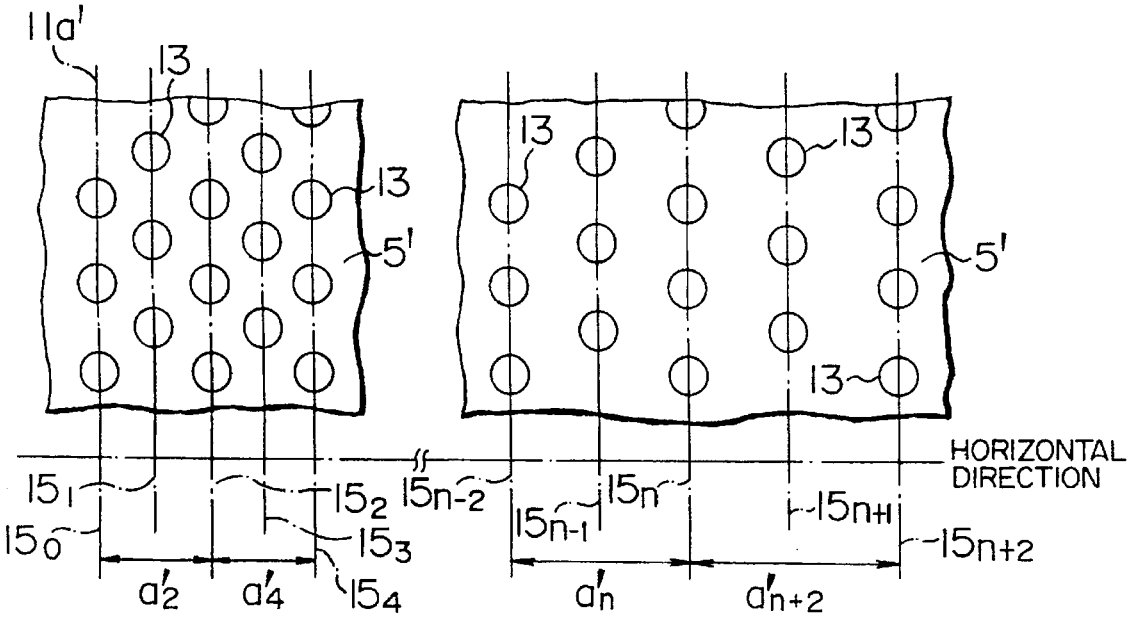

FIGS. 3*a* and 3*b* are diagrams of the construction of part of an example of the shadow mask for use in the color cathode-ray tube of this embodiment. FIG. 3*a* shows a stripe-shaped shadow mask 5 and FIG. 3*b* shows a dot-shaped shadow mask 5.

In FIGS. 3*a* and 3*b*, there are shown a tube axis 11*a* (11*a*'), slit-shaped holes 12 through which the electron beams pass, circular holes 13 through which the electron beams pass, vertical center lines $\mathbf{14}_0$, $\mathbf{14}_1$, $\mathbf{14}_2$, $\mathbf{14}_3$, . . . $\mathbf{14}_{n-1}$, $\mathbf{14}_n$, $\mathbf{14}_{n+1}$, $\mathbf{14}_{n+2}$ which connect the centers of the respective slit-shaped holes 12 for electron beam passage, and vertical center lines $\mathbf{15}_0$, $\mathbf{15}_1$, $\mathbf{15}_2$, $\mathbf{15}_3$, $\mathbf{15}_4$. . . $\mathbf{15}_{n-2}$, $\mathbf{15}_{n-1}$, $\mathbf{15}_n$, $\mathbf{15}_{n+1}$, $\mathbf{15}_{n+2}$ which connect the centers of the respective circular holes 13.

As illustrated in FIG. 3*a*, the stripe-shape shadow mask 5 has a plurality of slit-shaped holes 12 for electron beam passage provided along each of the vertical center lines $\mathbf{14}_0$, $\mathbf{14}_1$, $\mathbf{14}_2$, $\mathbf{14}_3$, . . . $\mathbf{14}_{n-1}$, $\mathbf{14}_n$, $\mathbf{14}_{n+1}$, $\mathbf{14}_{n+2}$. In this case, when the slit-shaped holes 12 for electron beam passage are formed, the distance (arrangement pitch) between the center line $\mathbf{14}_0$ closest to the central portion of the shadow mask 5 and the next adjacent center line $\mathbf{14}_1$ is determined as $a_1$, the distance (arrangement pitch) between the center line $\mathbf{14}_1$ and the next adjacent center line $\mathbf{14}_2$ as $a_2$, the distance (arrangement pitch) between the center line $\mathbf{14}_2$ and the next adjacent center line $\mathbf{14}_3$ as $a_3$, . . . the distance (arrangement pitch) between the center line $\mathbf{14}_{n-1}$ and the next adjacent center line $\mathbf{14}_n$ as $a_n$, the distance (arrangement pitch) between the center line $\mathbf{14}_n$ and the next adjacent center line $\mathbf{14}_{n+1}$ as $a_{n+1}$, and the distance (arrangement pitch) between the center line $\mathbf{14}_{n+1}$ and the next adjacent center line $\mathbf{14}_{n+2}$ as $a_{n+2}$.

As illustrated in FIG. 3*b*, the dot-shaped shadow mask 5' has a plurality of circular holes 13 for electron beam passage provided along each of the vertical center lines $\mathbf{15}_0$, $\mathbf{15}_1$, $\mathbf{15}_2$, $\mathbf{15}_3$, $\mathbf{15}_4$, . . . $\mathbf{15}_{n-2}$, $\mathbf{15}_{n-1}$, $\mathbf{15}_n$, $\mathbf{15}_{n+1}$, $\mathbf{15}_{n+2}$. In this case, when the circular holes 13 for electron beam passage are formed, the distance (arrangement pitch) between the center line $\mathbf{15}_0$ closest to the central portion of the shadow mask 5' and the next alternate center line $\mathbf{15}_2$ is determined as $a'_2$, the distance (arrangement pitch) between the center line $\mathbf{15}_2$ and the next alternate center line $\mathbf{15}_4$ as $a'_4$, . . . the distance (arrangement pitch) between the center line $\mathbf{15}_{n-2}$ and the next alternate center line $\mathbf{15}_n$ as $a'_n$, and the distance (arrangement pitch) between the center line $\mathbf{15}_n$ and the next alternate center line $\mathbf{15}_{n+2}$ as $a'_{n+2}$.

The shadow mask 5, 5' of the cathode-ray tube of this embodiment which has a slightly spherical shape (a spherical shape having large radius of curvature) is different in shape from the known shadow mask of this kind as described below. In addition, because of the difference in shape, the horizontal arrangement pitch of the holes 12, 13 in the shadow mask 5, 5' is different from that of the known shadow mask. Since the other constructions are the same as the known cathode-ray tube of this kind, the operation of the cathode-ray tube of this embodiment will not be described.

Figure 4:
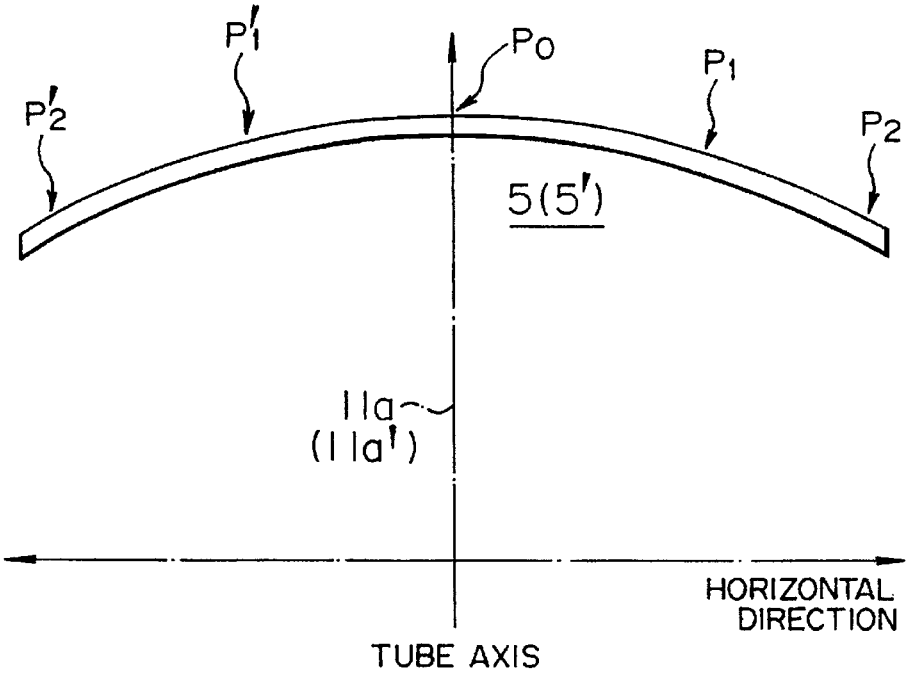
FIG. 4 is a horizontal cross-sectional diagram of the shadow mask for use in the color cathode-ray tube in FIG. 2.

FIG. 4 is a cross-sectional diagram, taken along the horizontal direction, of the shadow mask shown in FIGS. 3*a* or 3*b*.

In the cross-section of the shadow mask 5, 5' the radius of curvature is made substantially constant with a relatively large value in first regions ranging from its central portion $P_0$ and its vicinity to the intervening portions $P_1(P'_1)$ and their vicinity which lie between the central portion $P_0$ and peripheral portions $P_2(P'_2)$, but gradually reduced in the second regions ranging from the intervening portions $P_1(P'_1)$ and their vicinity to the peripheral portions $P_2(P'_2)$ and their vicinity as the distance to the peripheral portions $P_2$ $(P'_2)$ becomes smaller. Therefore if the radius of curvature at the central portion $P_0$ and its vicinity is represented by R1 and that at the peripheral portions $P_2(P'_2)$ and their vicinity by R2, then the shadow mask can be shaped to satisfy the condition of R1>>R2. On the other hand, the radius of curvature in the cross-section of the known shadow mask is relatively gently reduced along the direction from the central portion and its vicinity toward the peripheral portions. Therefore, if the radius of curvature at the central portion and its vicinity is represented by R1 and that at the peripheral portions and their vicinity by R2, then the known shadow mask is shaped to satisfy the condition of R1>R2.

Examples of the radii of curvature R1 and R2 according to this embodiment will be shown below along with those according to the prior art. In this connection, the shadow masks having the radii of curvature R1 and R2 are those for use in a wide (laterally long) TV cathode-ray tube having an effective diagonal diameter of 76 cm and having $Ph_2=1.25\ Ph_0$, where $Ph_2$ is the hole arrangement pitch at the peripheral portions $P_2$ and $Ph_0$ is the hole arrangement pitch at the central portion $P_0$.

| | R1 (mm) | R2 (mm) |
|---|---|---|
| PRESENT EMBODIMENT | 2,072 | 1,044 |
| PRIOR ART | 1,801 | 1,602 |

According to the construction of this embodiment, as compared with the conventional shadow mask, the mechanical strength can be increased, and thus the shadow mask can be prevented from being deformed by shock or the like and the doming and howling can be suppressed.

Figure 5:
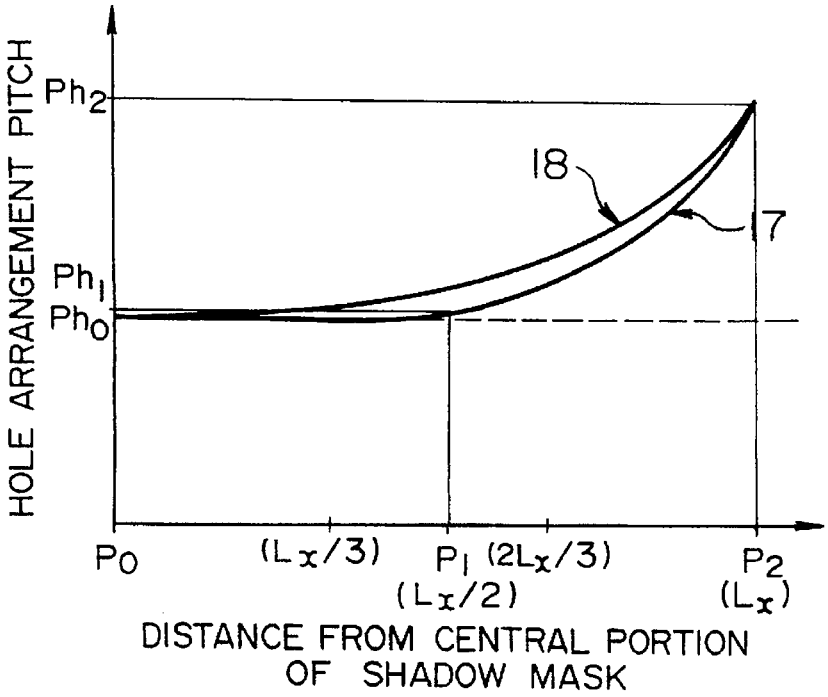
FIG. 5 is a graph showing the relation between the horizontal distance from the central portion of the shadow mask and the horizontal arrangement pitch of the holes in the shadow mask.

FIG. 5 is a graph showing a relation between the horizontal distance from the central portion at an arbitrary vertical level on the shadow mask and the horizontal arrangement pitch of the holes at corresponding distances on the shadow mask of one embodiment of the invention. The abscissa represents the distance from the central portion, and the ordinate represents the horizontal arrangement pitch.

In FIG. 5, curve 17 indicates one example of the arrangement pitch of the holes in the shadow mask 5(5') for use in the cathode-ray tube of the invention, and curve 18 shows an example of the arrangement pitch of the holes in the known shadow mask.

From FIG. 5, it will be seen that the hole arrangement pitch of the conventional shadow mask, as represented by curve 18, is gradually increased in the regions from the central portion $P_0$ and its vicinity of the shadow mask to the peripheral portions $P_2(P'_2)$ as the distance from the central portion becomes larger. In other words, if the arrangement pitches $a_1$, $a_2$, $a_3$, $a_n$, $a_{n+1}$, $a_{n+2}$ are used as shown in FIGS. 3*a* and 3*b*, the conditions of $a_1 \leqq a_2 \leqq a_3$, $a_n \leqq a_{n+1} \leqq a_{n+2} \leqq$ should be satisfied.

On the other hand, the hole arrangement pitch the shadow mask 5(5') of this embodiment is initially substantially constant and then monotonically increased in the region from the central portion $P_0$ and its vicinity of the shadow mask 5(5') to the peripheral portions $P_2(P'_2)$. In this case, the hole arrangement pitch is substantially constant in the first regions from the central portion $P_0$ and its vicinity of the shadow mask 5(5') toward the intervening portions $P_1(P'_1)$ which lie between the central portion $P_0$ and the peripheral portions $P_2(P'_2)$, but it is relatively rapidly increased in the second regions from the intervening portions $P_1(P'_1)$ toward the peripheral portions $P_2(P'_2)$ as the distances from the central portion $P_0$ becomes larger. In other words, if the arrangement pitches $a_1$, $a_2$ and $a_3$ are those $(Ph_0)$ at the central portion $P_0$ and its vicinity and the arrangement pitches $a_n$, $a_{n+1}$ and $a_{n+2}$ are those $(Ph_2)$ at the peripheral portions $P_2(P'_2)$ and their vicinity, then the conditions of $a_1 \cong a_2 \cong a_3$ and $a_n < a_{n+1} < a_{n+2}$ should be satisfied. The increase in the hole arrangement pitch in the second regions should have a gradient (a rate of increase) which is not smaller than zero, and which may be constant or increasing.

The expression "the hole arrangement pitch is substantially constant" for in the first regions mentioned above is intended to indicate that, assuming that the arrangement pitch at and in the vicinity of the central portion $P_0$ of the shadow mask is $Ph_0$, the hole arrangement pitch $Ph_1$ for the first regions is substantially in a range between $Ph_0$ and $1.005\ Ph_0$.

Further, the "intervening portions $P_1$ $(P_{1'})$" is intended to indicate a portion of the shadow mask at which the bole arrangement pitch Starts to relatively rapidly increase from a value $Ph_1$ (the arrangement pitch in the first regions, taking a value in a range between $Ph_0$ and $1.005\ Ph_0$ as described above, and shown as being equal to $1.005\ Ph_0$ in FIG. 5). And, assuming that a distance between portion $P_0$ and portion $P_2(P_2')$ (one-half of the effective horizontal width of the shadow mask) is $L_x$, the distance between portion $P_0$ and portion $P_1(P_i')$ should be between about $L_x/3$ and about $2L_x/3$, most preferably about $L_x/2$. In this case, it is preferable that the arrangement pitch $Ph_2$ at portion $P_2(P_2')$ is 1.1 $Ph_0$ to 1.5 $Ph_0$ as shown in FIG. 5.

If the distance between point $P_0$ and point $P_1$ $(P_1')$ is much larger than $2L_x/3$, the doming suppression effect at and in the vicinity of the intervening portions $P_1(P_1')$ will be small, while if the distance is much smaller than $L_x/3$, a substantial increase of the mechanical strength of the shadow mask will not be obtained.

Therefore, according to this embodiment, the radius of curvature in the cross-section of the shadow mask 5(5') of the color cathode-ray tube can be made substantially constant in the region from the central portion and its vicinity toward the intervening portions and their vicinity, but gradually decreasing in the regions from the intervening portions toward the peripheral portions, and the relation between the radius of curvature R1 at the central portion and its vicinity of the shadow mask and the radius of curvature R2 at the peripheral portions and their vicinity can satisfy the condition of R1>R2. Therefore, the mechanical strength can be increased and thus the shadow mask can be prevented from being deformed and the doming and howling can be suppressed.

Moreover, the increase of the hole arrangement pitch for the shadow mask in the vertical direction, as well as that in the horizontal direction as described in the above embodiment, may be made substantially zero in third regions from the central portion of the shadow mask toward intervening portions and may be made to have a gradient (a rate of increase) which is not smaller than zero, and which may be constant or increasing in fourth regions from the intervening portions toward the peripheral portions.

We claim:

1. A shadow mask for use in a color cathode-ray tube, said shadow mask comprising:

a metal plate in which a plurality of holes are formed for passage of electron beams therethrough in the color cathode-ray tube, said holes being arranged with a varying arrangement pitch, said varying arrangement pitch being monotonically non-decreasing from a central portion to two opposite peripheral portions of said shadow mask as viewed, in a first direction conforming with a horizontal direction in the color cathode-ray tube, at an arbitrary position on said shadow mask in a second direction perpendicular to said first direction;

wherein an increase of said varying arrangement pitch in said first direction is substantially zero in first regions from said central portion to intervening portions between said central portion and said two opposite peripheral portions of said shadow mask;

wherein an increase of said varying arrangement pitch in said first direction has a gradient not smaller than zero in second regions from said intervening portions toward said two opposite peripheral portions of said shadow mask;

wherein a distance between said central portion and each of said two opposite peripheral portions of said shadow mask is $L_x$;

wherein a distance between said central portion and each of said intervening portions is at least $L_x/2$ and not more than $2L_x/3$;

wherein said varying arrangement pitch at said central portion is $Ph_0$; and wherein said varying arrangement pitch in said first regions is at least $Ph_0$ and not greater than 1,005 $Ph_0$.

2. A shadow mask according to claim 1, wherein said holes are substantially circular.

3. A shadow mask according to claim 1, wherein said holes are of a substantially slit-shaped.

4. A shadow mask according to claim 1, wherein said holes are further arranged with a second varying arrangement pitch, said second varying arrangement pitch being monotonically non-decreasing from said central portion to second two opposite peripheral portions of said shadow mask as viewed in said second direction at an arbitrary position on said shadow mask in said first direction;

wherein an increase of said second varying arrangement pitch in said second direction is substantially zero in third regions from said central portion to second intervening portions between said central portion and said second two opposite peripheral portions of said shadow mask;

wherein an increase of said second varying arrangement pitch in said second direction has a gradient not smaller than zero in fourth regions from said second intervening portions toward said second two opposite peripheral portions of said shadow mask;

wherein a distance between said central portion and each of said second two opposite peripheral portions of said shadow mask is $L_y$; and wherein a distance between said central portion and each of said second intervening portions is at least $L_y/3$ and not more than $2L_y/3$.

5. A color cathode-ray tube having a shadow mask as defined in claim 1.

6. A color cathode-ray tube having a shadow mask as defined in claim 4.

7. A shadow mask according to claim 4, wherein said second varying arrangement pitch at said central portion is $Ph_0$, and wherein said second varying arrangement pitch in said third regions is at least $Ph_0$ and not greater than 1,005 $Ph_0$.

8. A shadow mask according to claim 1, wherein $L_x$ is one-half of an effective horizontal width of said shadow mask.

9. A shadow mask according to claim 1, wherein a radius of curvature of a cross-section of said shadow mask taken along said first direction is substantially constant in said first regions from said central portion to said intervening portions, and gradually decreases in said second regions from said intervening portions toward said two opposite peripheral portions of said shadow mask.

10. A shadow mask according to claim 9, wherein said varying arrangement pitch at said two opposite peripheral portions of said shadow mask is 1.25 $Ph_0$.

11. A shadow mask according to claim 4, wherein $L_y$ is one-half of an effective vertical width of said shadow mask.

12. A shadow mask according to claim 4, wherein the distance between said central portion and each of said intervening portions is at least $L_y/2$ and not more than $2L_x/3$.

13. A color cathode-ray tube comprising:

an envelope having a panel portion, a neck portion, and a funnel portion coupling said panel portion and said neck portion to each other;

an electron gun mounted within said neck portion for producing electron beams;

a phosphor screen formed on an inner surface of said panel portion; and a shadow mask having a plurality of holes therein and disposed opposing said phosphor screen so that said electron beams pass through holes in said shadow mask to impinge on said phosphor screen;

wherein said holes are arranged with a varying arrangement pitch, said varying arrangement pitch being monotonically non-decreasing from a central portion to two opposite peripheral portions of said shadow mask as viewed, in a horizontal direction in the color cathode-ray tube, at an arbitrary position on said shadow mask in a vertical direction in the color cathode-ray tube;

wherein an increase of said varying arrangement pitch in said horizontal direction is substantially zero in first regions from said central portion to intervening portions between said central portion and said two opposite peripheral portions of said shadow mask;

wherein an increase of said varying arrangement pitch in said horizontal direction has a gradient not smaller than zero in second regions from said intervening portions toward said two opposite peripheral portions of said shadow mask;

wherein a distance between said central portion and each of said two opposite peripheral portions of said shadow mask is $L_x$;

wherein a distance between said central portion and each of said intervening portions is at least $L_x/2$ and not more than $2L_x/3$;

wherein said varying arrangement pitch at said central portion is $Ph_0$; and wherein said varying arrangement pitch in said first regions is at least $Ph_0$ and not greater than 1.005 $Ph_0$.

14. A color cathode-ray tube according to claim 13, wherein $L_x$ is one-half of an effective horizontal width of said shadow mask.

15. A color cathode-ray tube according to claim 13, wherein a radius of curvature of a cross-section of said shadow mask taken along said horizontal direction is substantially constant in said first regions from said central portion to said intervening portions, and gradually decreases in said second regions from said intervening portions toward said two opposite peripheral portions of said shadow mask.

16. A color cathode-ray tube according to claim 15, wherein said varying arrangement pitch at said two opposite peripheral portions of said shadow mask is $1.25Ph_0$.

17. A shadow mask for use in a color cathode-ray tube, said shadow mask comprising:

a metal plate in which a plurality of holes are formed for passage of electron beams therethrough in the color cathode-ray tube, said holes being arranged with a varying arrangement pitch, said varying arrangement pitch being monotonically non-decreasing from a central portion to two opposite peripheral portions of said shadow mask as viewed, in a first direction conforming with a horizontal direction in the color cathode-ray tube, at an arbitrary position on said shadow mask in a second direction perpendicular to said first direction;

wherein an increase of said varying arrangement pitch in said first direction is substantially zero in first regions from said central portion to intervening portions between said central portion and said two opposite peripheral portions of said shadow mask;

wherein an increase of said varying arrangement pitch in said first direction has a gradient not smaller than zero in second regions from said intervening portions toward said two opposite peripheral portions of said shadow mask;

wherein a distance between said central portion and each of said two opposite peripheral portions of said shadow mask is $L_x$;

wherein a distance between said central portion and each of said intervening portions is at least $L_x/3$ and not more than $2L_x/3$;

wherein said varying arrangement pitch at said central portion is $Ph_0$;

wherein said varying arrangement pitch in said first regions is at least $Ph_0$ and not greater than 1.005 $Ph_0$;

wherein a radius of curvature of a cross-section of said shadow mask taken along said first direction is substantially constant in said first regions from said central portion to said intervening portions, and gradually decreases in said second regions from said intervening portions toward said two opposite peripheral portions of said shadow mask;

wherein said radius of curvature is R1 at said central portion, substantially R1 at said intervening portions, and R2 at said two opposite peripheral portions of said shadow mask; and wherein R1/R2 is substantially 1.98.

18. A color cathode-ray tube comprising:

an envelope having a panel portion, a neck portion, and a funnel portion coupling said panel portion and said neck portion to each other;

an electron gun mounted within said neck portion for producing electron beams;

a phosphor screen formed on an inner surface of said panel portion; and a shadow mask having a plurality of holes therein and disposed opposing said phosphor screen so that said electron beams pass through holes in said shadow mask to impinge on said phosphor screen;

wherein said holes are arranged with a varying arrangement pitch, said varying arrangement pitch being monotonically non-decreasing from a central portion to two opposite peripheral portions of said shadow mask as viewed, in a horizontal direction in the color cathode-ray tube, at an arbitrary position on said shadow mask in a vertical direction in the color cathode-ray tube;

wherein an increase of said varying arrangement pitch in said horizontal direction is substantially zero in first regions from said central portion to intervening portions between said central portion and said two opposite peripheral portions of said shadow mask;

wherein an increase of said varying arrangement pitch in said horizontal direction has a gradient not smaller than zero in second regions from said intervening portions toward said two opposite peripheral portions of said shadow mask;

wherein a distance between said central portion and each of said two opposite peripheral portions of said shadow mask is $L_x$;

wherein a distance between said central portion and each of said intervening portions is at least $L_x/3$ and not more than $2L_x/3$;

wherein said varying arrangement pitch at said central portion is $Ph_0$;

wherein said varying arrangement pitch in said first regions is at least $Ph_0$ and not greater than $1.005Ph_0$;

wherein a radius of curvature of a cross-section of said shadow mask taken along said horizontal direction is substantially constant in said first regions from said central portion to said intervening portions, and gradually decreases in said second regions from said intervening portions toward said two opposite peripheral portions of said shadow mask;

wherein said radius of curvature is R1 at said central portion, substantially R1 at said intervening portions, and R2 at said two opposite peripheral portions of said shadow mask; and wherein R1/R2 is substantially 1.98.

* * * * *